US005095584A

United States Patent [19]

Temburg

[11] Patent Number: 5,095,584

[45] Date of Patent: Mar. 17, 1992

[54] CARDING MACHINE WITH A WASTE SEPARATOR

[75] Inventor: Konrad Temburg, Mönchengladbach, Fed. Rep. of Germany

[73] Assignee: Trützschler GmbH & Co. KG, Möchengladbach, Fed. Rep. of Germany; DEX

[21] Appl. No.: 469,947

[22] Filed: Jan. 25, 1990

[30] Foreign Application Priority Data

Jan. 26, 1989 [DE] Fed. Rep. of Germany ..... 3902202

[51] Int. Cl.[5] ..... D01G 15/74

[52] U.S. Cl. ..... 19/107

[58] Field of Search ..... 19/107, 108

[56] References Cited

U.S. PATENT DOCUMENTS

| | | | |
|---|---|---|---|
| 4,219,908 | 9/1980 | Winch et al. | 19/107 |
| 4,301,573 | 11/1981 | Gunter et al. | 19/107 |
| 4,309,796 | 1/1982 | Garrison et al. | 19/107 |
| 4,314,387 | 2/1982 | Löffler | 19/107 |
| 4,317,260 | 3/1982 | Blackborn | 19/107 |
| 4,379,357 | 4/1983 | Beneke et al. | 19/107 |
| 4,400,852 | 8/1983 | Löffler | 19/107 |
| 4,472,859 | 9/1984 | Elliott et al. | 19/107 |
| 4,524,492 | 6/1985 | Elliott | 19/107 |
| 4,797,980 | 1/1989 | Jagst . | |
| 4,811,464 | 3/1989 | Giuliani | 19/107 |
| 4,815,170 | 3/1989 | Portell | 19/107 |

FOREIGN PATENT DOCUMENTS

| | | | |
|---|---|---|---|
| 295060 | 12/1988 | European Pat. Off. . | |
| 1510434 | 1/1970 | Fed. Rep. of Germany . | |
| 3346092 | 7/1984 | Fed. Rep. of Germany | 19/107 |
| 3343936 | 8/1984 | Fed. Rep. of Germany . | |
| 3702588 | 10/1987 | Fed. Rep. of Germany . | |
| 2822415 | 2/1988 | Fed. Rep. of Germany . | |
| 81598 | 5/1962 | France | 19/107 |
| 971830 | 10/1964 | United Kingdom | 19/107 |

*Primary Examiner*—Werner H. Schroeder
*Assistant Examiner*—John J. Calvert
*Attorney, Agent, or Firm*—Spencer & Frank

[57] ABSTRACT

A carding machine has a main carding cylinder; a licker-in; a doffer; and at least two cover plates extending in a circumferential direction along a peripheral portion of the carding cylinder. The cover plates are situated below the carding cylinder and are circumferentially spaced from one another to define a waste-discharge opening therebetween. A mote knife adjoins an end of one of the cover plates and bounds the waste-discharge opening. There is further provided a suction chamber situated adjacent the mote knife and the waste-discharge opening for drawing away waste passing through the waste-discharge opening from the carding cylinder.

9 Claims, 5 Drawing Sheets

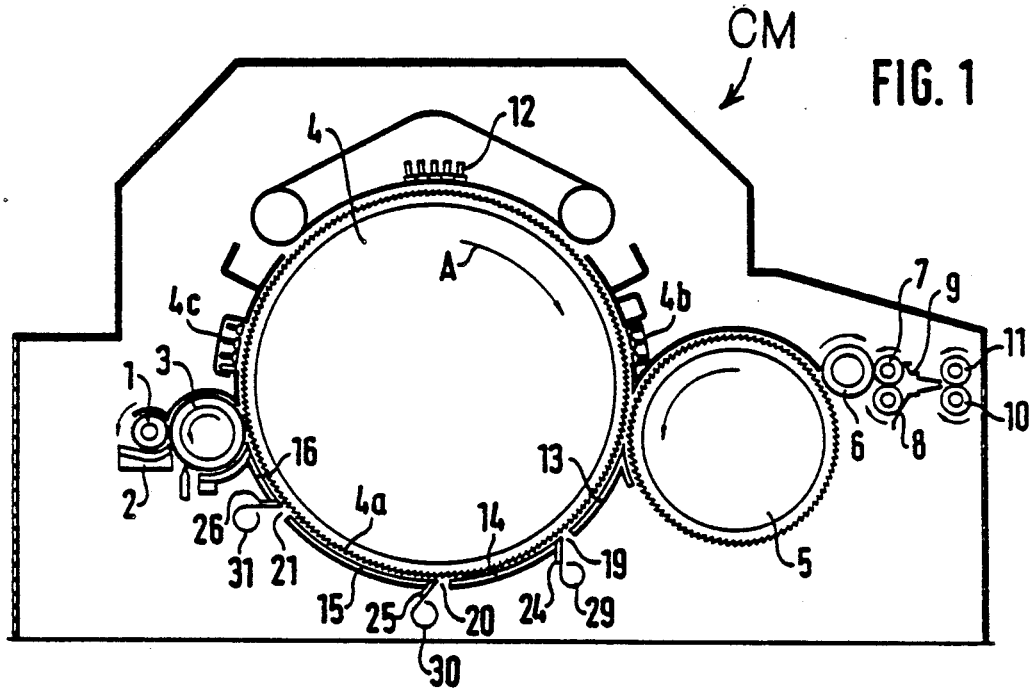
FIG. 1
FIG. 2
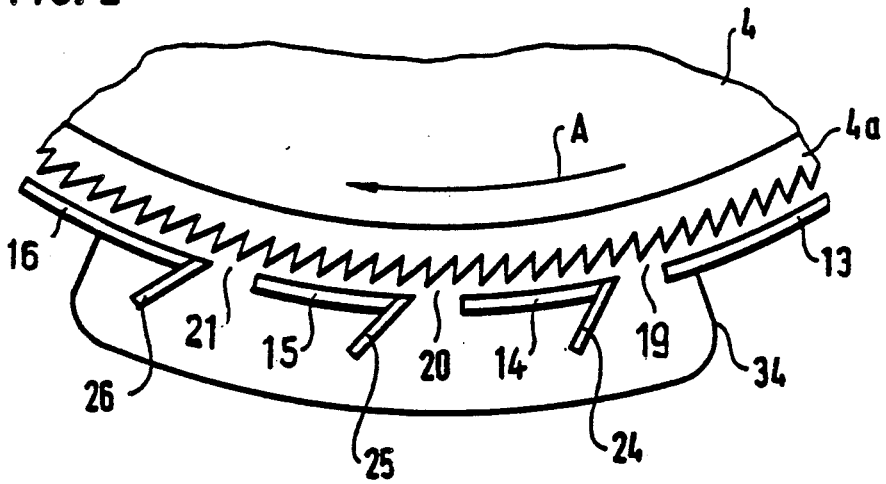

CARDING MACHINE WITH A WASTE SEPARATOR

CROSS REFERENCE TO RELATED APPLICATION

This application claims the priority of Federal Republic of Germany Application No. P 39 02 202.1 filed Jan. 26th, 1989, which is incorporated herein by reference.

BACKGROUND OF THE INVENTION

This invention relates to a waste separator which is associated with a carding machine. Underneath the main carding cylinder cover elements are arranged which are thus situated between the doffer and the licker-in and which define openings (also referred to as waste-removal or waste-discharge openings) for the separation of trash, dust and the like from th fiber material worked by the carding cylinder. The openings are bounded by mote knives secured to the cover elements. In known arrangements of this type the waste which exits the waste-removal openings falls into a lower card space which is exposed to suction. Due to the air which is generated by the rotation of the carding cylinder and which rushes out through the waste-removal openings and because of the non-uniform suction effect over the entire lower carding space, disadvantageous turbulences are generated therein. Since above the carding cylinder, that is, between the licker-in and the doffer as viewed in the direction of rotation of the carding cylinder, larger waste particles have already been removed particularly by the travelling flats, by means of the mote knives situated underneath the carding cylinder between the doffer and the licker-in finer impurities including dust are being removed. Such finer impurities and dust are disadvantageously swirling under the effect of the non-uniform air flows in the lower carding space. As a result, they tend to settle in the corners of the lower space of the carding machine in case they are not entrained by the suction stream.

SUMMARY OF THE INVENTION

It is an object of the invention to provide an improved arrangement of the above-outlined type with which the discussed disadvantages are eliminated and which, in particular, ensures a uniform removal, by suction, of the waste separated by the mote knives and passing through the waste-removal openings and thus prevents the generation of undesired turbulences in the lower carding space.

This object and others to become apparent as the specification progresses, are accomplished by the invention, according to which, briefly stated, a suction chamber is situated adjacent the mote knives and the associated waste-removal openings.

By associating a suction chamber with the mote knives and the waste-removal openings, impurities such as dust and the like are removed by suction immediately at the location of separation, thus preventing the waste from first falling into the lower carding space. At the same time, a positive removal by suction is effected, that is, the voluminous lower carding space need no longer be exposed to the suction effect which, by practicing the invention, may be purposefully localized and concentrated, also permitting a reduction in the flow rate. It is a particular advantage of the invention that turbulence of finer waste, including dust, is avoided.

BRIEF DESCRIPTION OF THE DRAWING

FIG. 1 is a schematic side elevational view of a carding machine incorporating the invention.

FIG. 2 is a schematic side elevational view of a preferred embodiment of the invention.

FIG. 4 is a schematic side elevational view of one part of the carding machine, showing the embodiment of FIG. 3 arranged underneath the main carding cylinder, between the doffer and the licker-in.

FIG. 8 is a schematic side elevational view of one part of the carding machine, showing the embodiment of FIG. 7 disposed underneath the main carding cylinder, between the doffer and the licker-in.

FIG. 9 is a schematic side elevational view of one part of the carding machine illustrating the preferred embodiment, generally corresponding to that shown in FIG. 7, arranged about the circumference of the licker-in.

DESCRIPTION OF THE PREFERRED EMBODIMENTS

Figure 3:
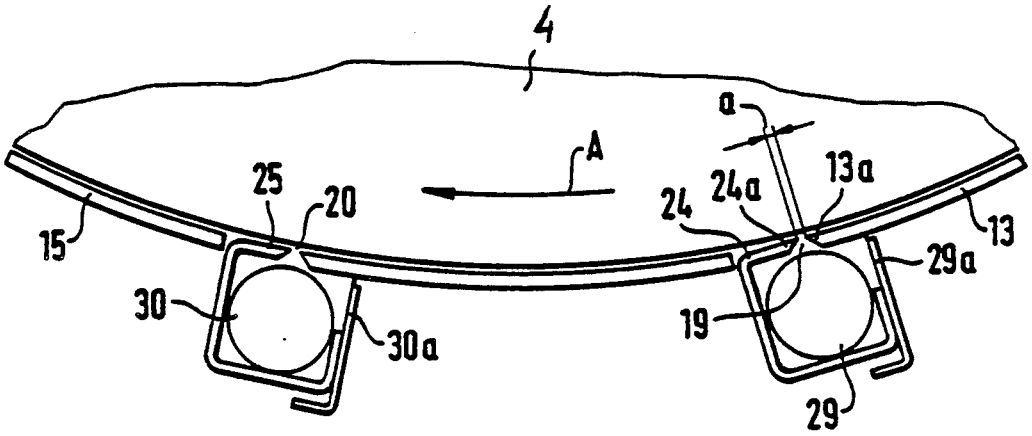
FIG. 3 is a schematic side elevational view of another preferred embodiment of the invention.

Turning to FIG. 1, there is illustrated therein a known carding machine generally designated at CM which may be, for example, an EXACTACARD DK 740 model, manufactured by Trützschler GmbH & Co. KG, Mönchengladbach, Federal Republic of Germany. The carding machine has a feed roller 1, a feed table 2, a licker-in 3, a main carding cylinder 4 having a direction of rotation A and being provided with a clothing 4*a*, a doffer 5, a stripping roller 6, two crushing rollers 7, a web guiding element 8, a sliver trumpet 9, two calender rollers 10, 11 and travelling flats 12. Between the doffer 5 and the travelling flats 12 as well between the travelling flats 12 and the licker-in 3 respective stationary carding elements 4*b* and 4*c* are positioned.

Underneath the carding cylinder 4, between the doffer 5 and the licker-in 3 covering elements, such as sheet metal plates 13, 14, 15 and 16 are arranged. Between adjoining ends of any two covering plates 13-16 a respective waste-discharge opening 19, 20 and 21 is provided through which waste such as trash, dust and the like may pass. The covering elements 14, 15 and 16 have, at their ends which oppose the rotary direction A of the carding cylinder 4, a respective mote knife 24, 25 and 26. Each mote knife 24, 25 and 26 and the associated waste-discharge opening 19, 20 and 21 is shrouded by a separate suction chamber 29, 30 and 31, each communicating with a non-illustrated suction source.

Turning to the embodiment illustrated in FIG. 2, three consecutive, serially arranged mote knives 24, 25 and 26 are shrouded by a single, common suction chamber 34.

Turning now to FIG. 3, there are illustrated therein two waste separators whose respective mote knife 24 and 25 and the associated respective suction chamber 29 and 30 are formed as a one-piece component as disclosed, for example, in U.S. Pat. No. 4,797,980. Between the cutting edge 24*a* of the mote knife 24 and the end 13*a* of the cover plate 13 the waste-discharge opening 19 has a width of, for example, a=5 mm and extends along the entire width of the carding cylinder 4. At the suction chambers 29 and 30 there is arranged a respective adjustable slide 29a and 30a, by means of which the flow rate of inflowing external air may be adjusted by varying the width of a gap between the respective slide and the associated covering plate, as also disclosed in U.S. Pat. No. 4,797,980.

Figure 4:
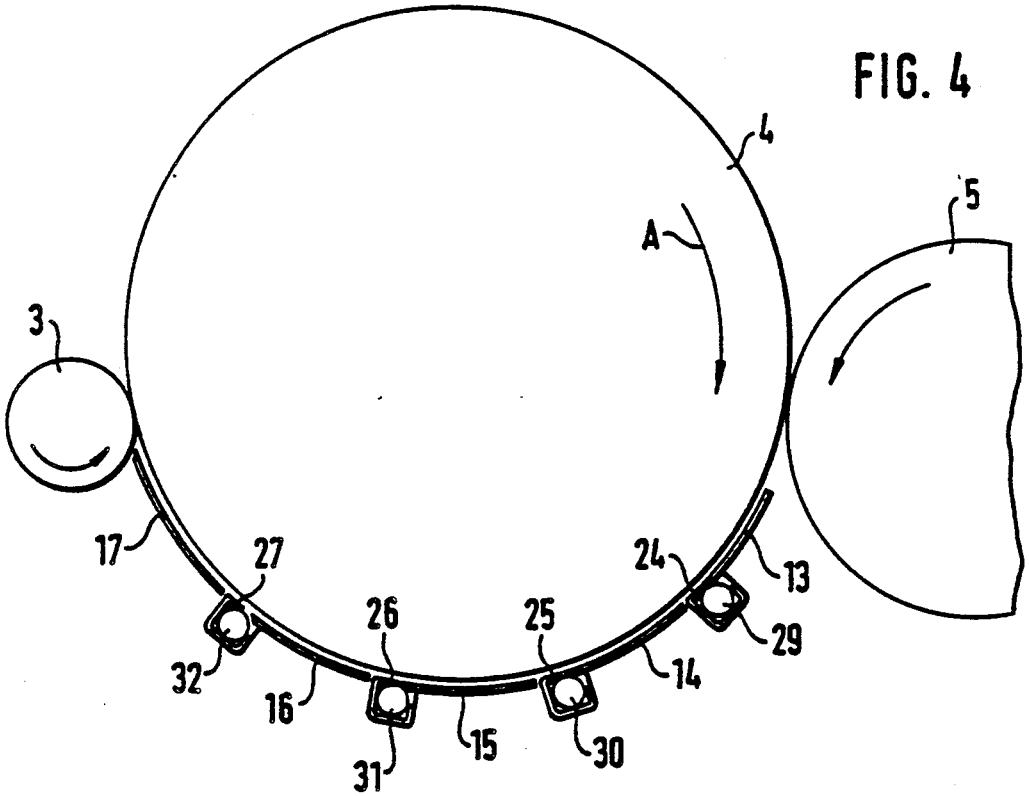

FIG. 4 illustrates four devices structured according to the FIG. 3 embodiment, situated along the bottom periphery of the carding cylinder 4 between the doffer 5 and the licker-in 3 of the carding machine.

Figure 5:
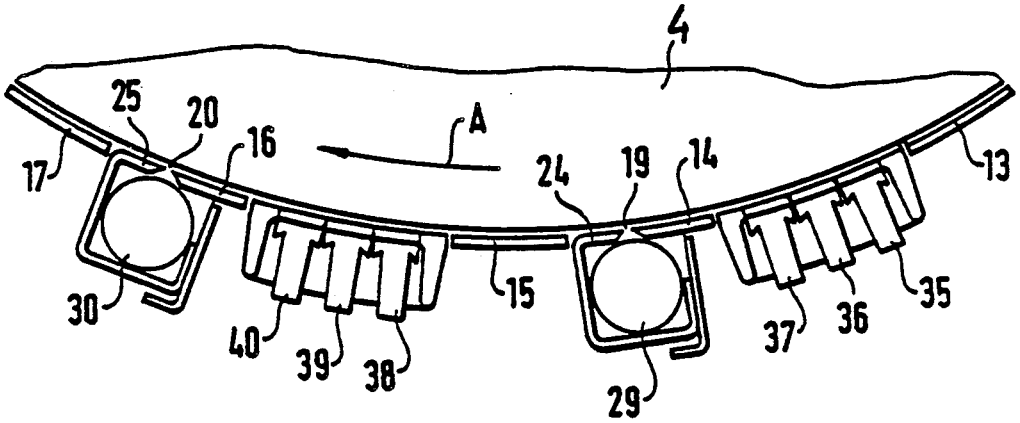
FIGS. 5, 6 and 7 are schematic side elevational views of three further preferred embodiments of the invention.
Figure 6:
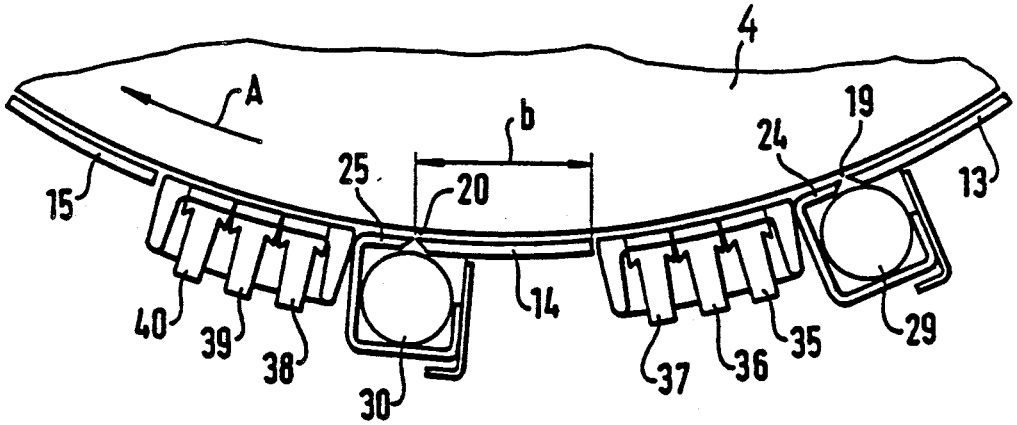

According to FIG. 5, with each mote knife 24 and 25 there are associated three clothed stationary carding elements 35, 36, 37 and 38, 39, 40, respectively, forming two stationary carding element groups which are immediately adjoining the respective mote knife 24 and 25 upstream thereof as viewed in the direction of rotation A of the main carding cylinder 4. The clothing of the stationary carding elements is increasingly finer in the direction of rotation A of the carding cylinder 4. Further, the stationary carding elements are individually adjustable in a radial direction towards or away from the carding cylinder. The embodiment illustrated in FIG. 6 differs from that shown in FIG. 5 in that each stationary carding element group is situated immediately downstream of the respective mote knife 24 and 25 as viewed in the rotary direction A. The length b of the cover element 14 measured in the circumferential direction of the carding cylinder 4 is at least about 100 mm.

Figure 7:
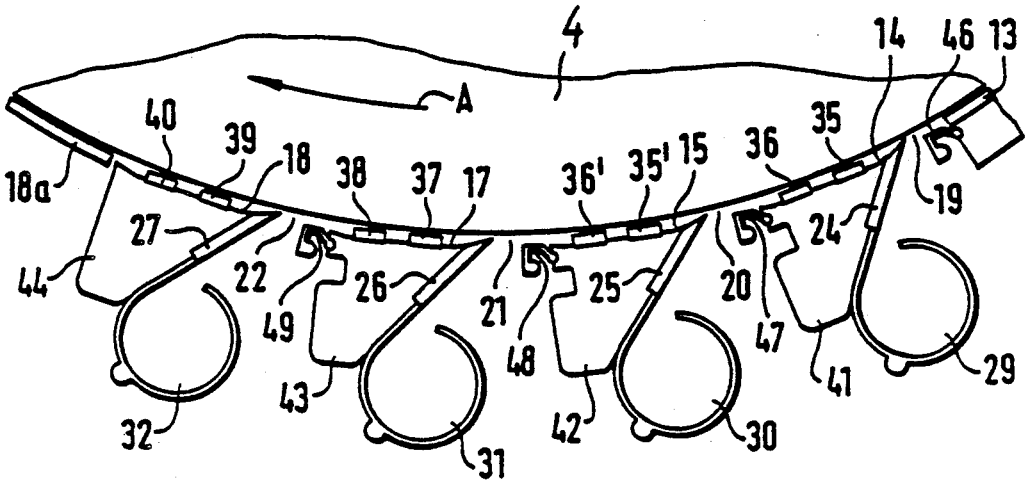

FIG. 7 illustrates four serially arranged waste separator units each having a mote knife 24–27, two groups of stationary carding elements 35, 36; 35', 36'; 37, 38; and 39, 40, as well as a suction chamber 29–32 and guide elements 46, 47 and 48 each being situated at the reverse side of a respective cover plate and each bounding a respective waste-discharge opening. Each guide element is adjustable towards and away from the cylinder 4. In each unit these components are supported on a respective carrier element 41, 42, 43 and 44 which may be, for example, a sheet metal frame.

Figure 8:
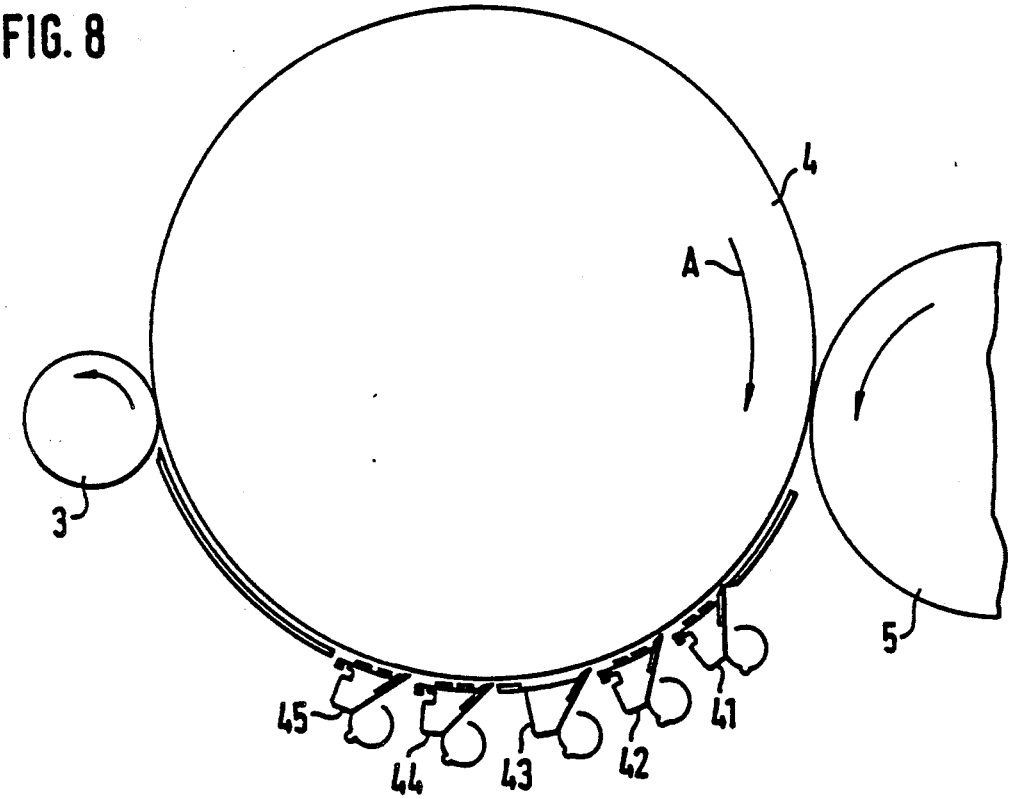

In the embodiment shown in FIG. 8, five units of the type shown in FIG. 7 are arranged underneath the carding cylinder 4; the center unit 43, however, has no stationary carding elements and also lacks a guide element.

Figure 9:
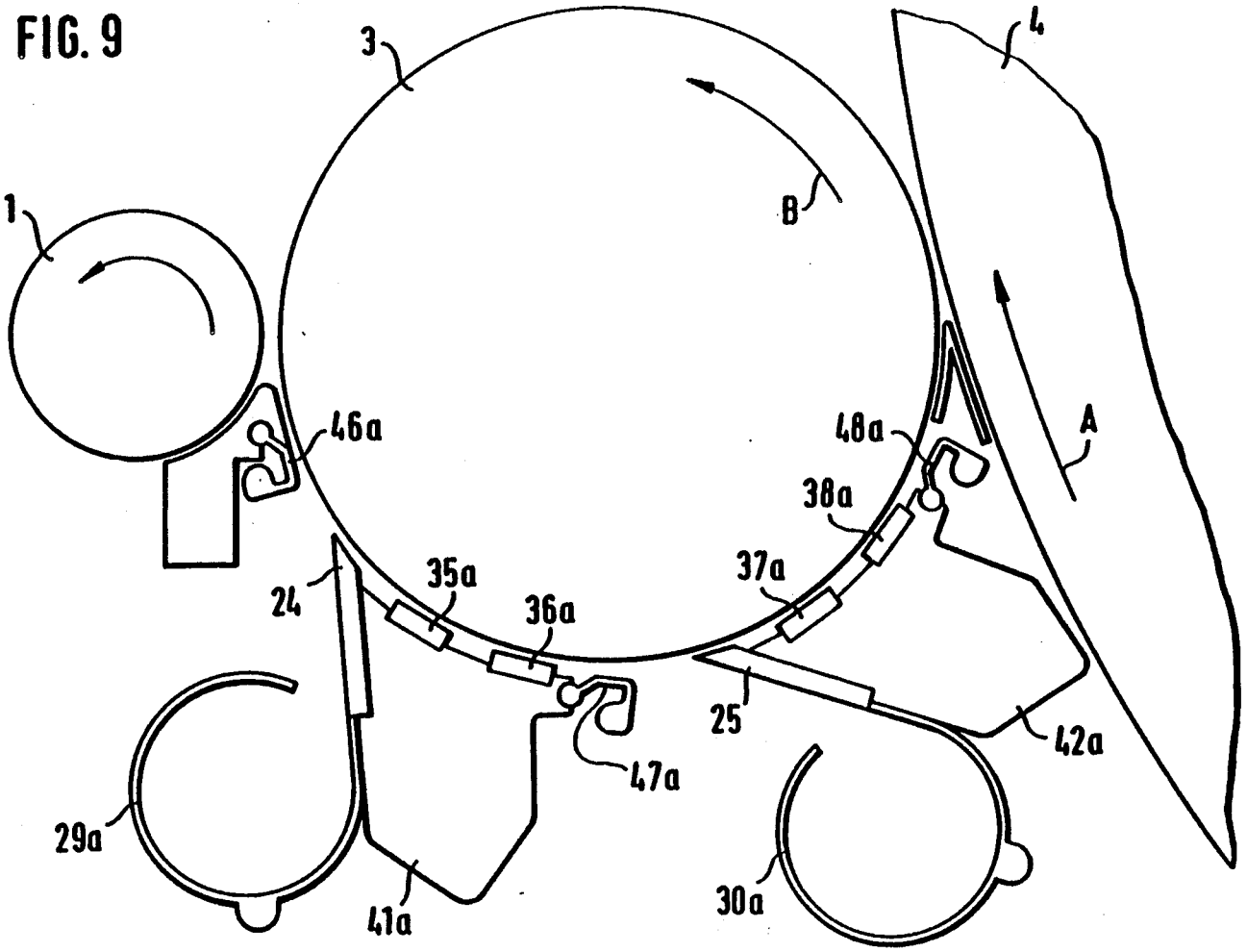

Turning to the embodiment illustrated in FIG. 9, there are shown therein two waste-removal units structured according to the invention, each having a mote knife 24, 25, stationary carding elements 35a–38a, suction chambers 29a, 30a and carrier elements 41a, 42a. The two waste-removal units are situated underneath the licker-in 3 of the carding machine. This arrangement ensures that the waste separated from the fiber material in the zone of the licker-in too, is channelled away by suction chambers and thus no undesired turbulence occurs in the lower space of the carding machine.

It is to be understood that the above-described waste-removal devices according to the invention may also be associated with the cylinder of a roller card unit.

It will be understood that the above description of the present invention is susceptible to various modifications, changes and adaptations, and the same are intended to be comprehended within the meaning and range of equivalents of the appended claims.

What is claimed is:

1. In a carding machine having a main carding cylinder having a direction of rotation; a licker-in and a doffer cooperating with the main carding cylinder; more than two cover plates extending in a circumferential direction along a peripheral portion of the carding cylinder and being situated below the carding cylinder; down stream of the doffer and upstream of the licker-in as viewed in said direction of rotation; said cover plates being circumferentially spaced from one another and defining a waste discharge opening therebetween; mote knives adjoining an end of respective said cover plates and bounding each said waste-discharge opening; the improvement comprising a suction chamber means situated adjacent each mote knife and each waste-discharge opening for immediately drawing away waste passing through each said waste-discharge opening from said carding cylinder; thereby reducing turbulence under the carding cylinder further wherein between any two adjoining mote knives there is situated one of said cover plates; each said cover plate has a minimum length of about 100 mm viewed in the circumferential direction.

2. A carding machine as defined in claim 1, said suction chamber means being formed of a single common chamber shrouding all of the mote knives and the waste-discharge openings.

3. A carding machine as defined in claim 1, said suction chamber means being formed of a plurality of suction chambers; with each said waste-discharge opening and the mote knife bounding a respective said waste-discharge opening there being associated a separate said suction chamber.

4. A carding machine as defined in claim 3 further comprising means for individually setting the strength of the suction in each of said suction chambers.

5. A carding machine as defined in claim 1, further wherein each said waste-discharge opening is bounded by a guide element secured to one of said cover plates.

6. A carding machine as defined in claim 5 wherein each said guide element is adjustable towards and away from the carding cylinder.

7. A carding machine as defined in claim 1, further comprising means defining an additional waste-discharge opening at a periphery of said licker-in and an additional mote knife bounding said additional waste-discharge opening; and an additional suction chamber means situated adjacent the additional mote knife and the additional waste-discharge opening for drawing away waste passing through said additional waste-discharge opening from said licker-in.

8. In a carding machine having a main carding cylinder having a direction of rotation; a licker-in and a doffer cooperating with the main carding cylinder; at least two cover plates extending in a circumferential direction along a peripheral portion of the carding cylinder and being situated below the carding cylinder; said cover plates being circumferentially spaced from one another and defining a waste-discharge opening therebetween; a mote knife adjoining an end of one of the cover plates and bounding said waste-discharge opening; the improvement comprising (a) a suction chamber means situated adjacent the mote knife and the waste-discharge opening for immediately drawing away waste passing through said waste-discharge opening from said carding cylinder; and (b) a group formed of a plurality of circumferentially adjoining stationary carding elements adjoining said mote knife downstream thereof, as viewed in said direction of rotation of said carding cylinder, said stationary carding elements having clothings which are increasingly finer in said direction of rotation.

9. A carding machine as defined in claim 4, wherein each said stationary carding element is individually adjustable in a radial direction towards and away from said carding cylinder.

* * * * *